United States Patent [19]

Hansard

[11] Patent Number: 5,003,942

[45] Date of Patent: Apr. 2, 1991

[54] ROTARY VANED VALVES

[76] Inventor: Gregory R. Hansard, 7045 Toma La., Penngrove, Calif. 94951

[21] Appl. No.: 517,292

[22] Filed: May 1, 1990

Related U.S. Application Data

[63] Continuation-in-part of Ser. No. 383,732, Jul. 21, 1989, abandoned.

[51] Int. Cl.[5] ..... F01L 7/00

[52] U.S. Cl. ..... 123/190 A; 123/190 BB; 60/598

[58] Field of Search ..... 123/190 A, 190 B, 190 BB, 123/25 A; 60/605.1, 598, 624

[56] References Cited

U.S. PATENT DOCUMENTS

| | | | |
|---|---|---|---|
| 1,890,326 | 12/1932 | Hansen | 123/190 R |
| 2,155,143 | 4/1939 | McDermett | 123/190 BB |
| 4,134,381 | 1/1979 | Little | 123/190 E |
| 4,370,955 | 2/1983 | Ruggeri | 123/190 BB |
| 4,556,023 | 12/1985 | Giocastro et al. | 123/190 A |

*Primary Examiner*—E. Rollins Cross

*Attorney, Agent, or Firm*—Larry D. Johnson

[57] ABSTRACT

A rotary valve provides incorporates one or more sets of blades or vanes within the tubular body member of the rotary valve, which vanes are independent of the rotary valve to enable them to be spun about the longitudinal axis of the tubular rotary valve at a significantly higher rate than the rotary valve itself. Thus, the normal rotation of the rotary valve (typically rotating at one-half crankshaft speed for a four-cycle engine) not only periodically aligns the ports of the valve with the ports of the cylinder head and enables intake/exhaust functions in the usual manner, but the internal spinning vanes (rotating at a much higher speed) provide additional thrust and, therefore, improved pressure, efficiency and flow characteristics to the gas flow.

10 Claims, 4 Drawing Sheets

ROTARY VANED VALVES

This application is a continuation-in-part of copending patent application Ser. No. 383,732, filed July 21, 1989, now abandoned.

BACKGROUND OF THE INVENTION

1. Field of the Invention

This invention relates generally to internal combustion engines, and more specifically to an improved intake and exhaust valve system for such engines.

2. Description of the Prior Art

Standard internal combustion engines typically utilize mechanically or hydraulically-lifted valves or poppets to enable introduction of the fuel/air mixture from the intake manifold into the cylinders, and to remove combustion gases from the cylinders to the exhaust manifold. One variation of this standard valving system utilizes a pair of rotary valves having tubular-shaped body members with staggered cut-outs or ports in the walls of the tubes. These rotary valves are turned by a gear or timing chain mechanism, bringing the ports of the tubes into alignment with the ports of the cylinders as appropriate for intake and exhaust functions. For example, Hansen U.S. Pat. No. 1,890,326 discloses a rotary valve structure for gas engines, while Giocastro et al. U.S. Pat. No. 4,556,023 teaches an improved method for rotary valves and gear timing.

However, it is felt that such prior art rotary valve systems yield poor fuel/air flow characteristics on the intake side, and poor combustion gas flow characteristics on the exhaust side. Futhermore, it is believed that known rotary intake valve systems provide insufficient atomization of the fuel.

SUMMARY OF THE INVENTION

The rotary vaned valves of this invention provide an improved intake and exhaust valve system for internal combustion engines using rotary-type valves. The inventive system incorporates one or more sets of blades or vanes within the tubular body member of the rotary valve, which vanes are independent of the rotary valve to enable them to be spun (driven) about the longitudinal axis of the (tubular) rotary valve at a significantly higher rate than the rotary valve itself. Thus, the normal rotation of the rotary valve (typically rotating at one-half crankshaft speed for a four-cycle engine) not only periodically aligns the ports of the valve with the ports of the cylinder head and enables intake/exhaust functions in the usual manner, but the internal spinning vanes (rotating at a much higher speed) provide additional thrust (and, therefore, improved pressure, efficiency and flow characteristics) to the gas flow. Furthermore, on the rotary intake valve side, these vanes significantly enhance fuel atomization of the fuel/air mixture.

These internal vanes can be driven by a step-up gear or belt system powered by the engine crankshaft. Alternatively, the intake vanes could be driven by a set of independently mounted vanes within the exhaust valve tube. Power from these exhaust driven vanes could then be transferred to the intake vanes via a geared crossshaft or other means. A further alternative utilizes power from the exhaust driven vanes to drive another engine component (e.g., an alternator).

A further design improvement in this invention is that the intake and exhaust ports in the head should be of a size to define an arc of approximately thirty degrees of the circle described by the outside circumference of the rotary valve tube, while the ports in the rotary tube itself should define an arc of approximately sixty degrees of that same circle. The benefit of this arrangement is to enable the valve port to be fully open for approximately thirty degrees of valve rotation, as compared to prior art rotary valve systems which which are fully open at only one specific instant in their rotation, and less than fully open for the remainder.

An alternate embodiment of this rotary vaned valve system incorporates a water injection system into the exhaust valve portion of the system, so that controlled quantities of water may be injected into the exhaust gas stream. The water thus introduced is vaporized into steam by the high exhaust gas temperatures, which steam is then exhausted through and serves to drive the exhaust valve vane set of the rotary exhaust valve, thereby further increasing exhaust efficiency.

DETAILED DESCRIPTION OF A PREFERRED EMBODIMENT

Figure 1:
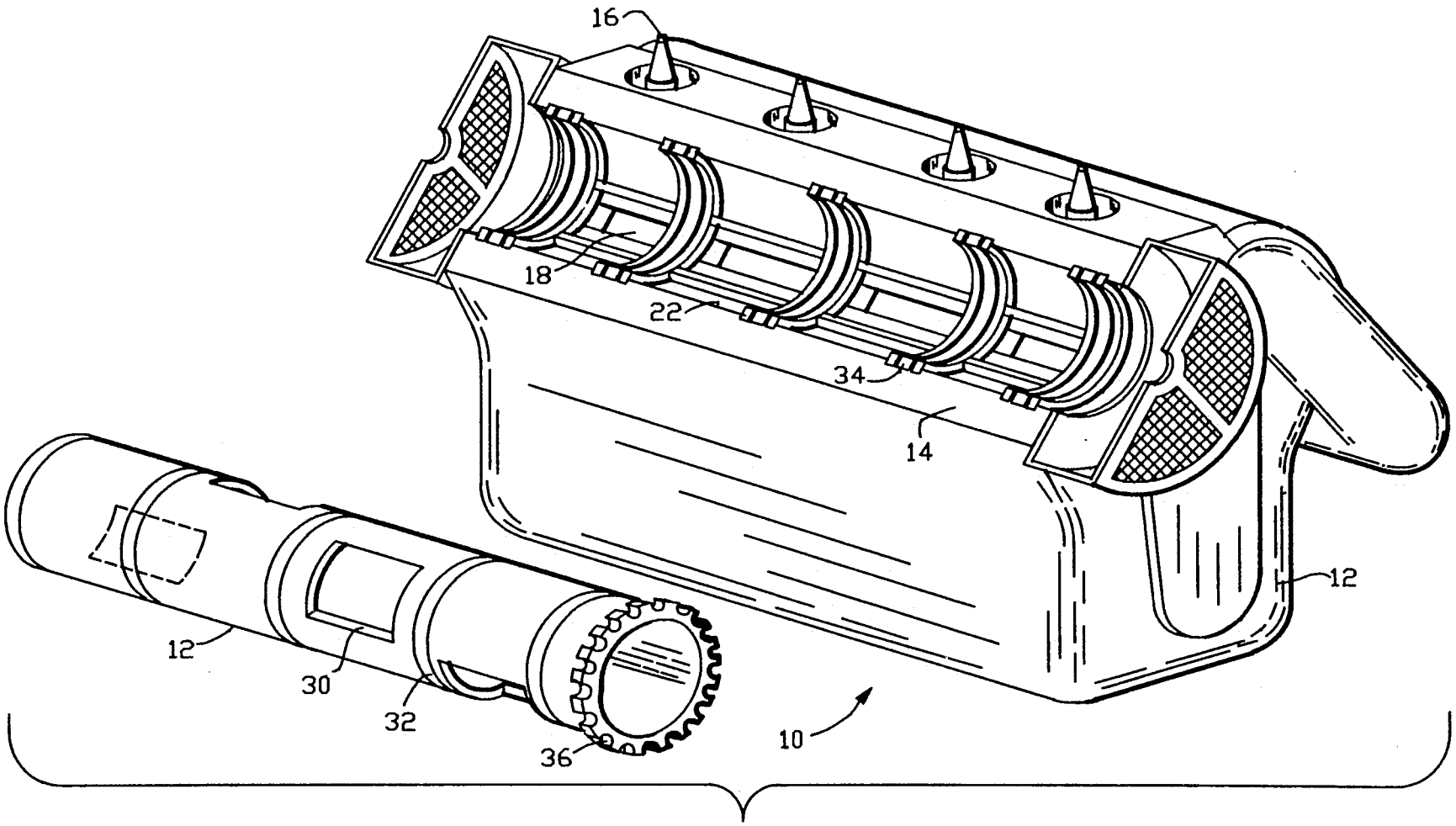
FIG. 1 is an exploded perspective view of an internal combustion engine block and head with a rotary vaned valve of this invention.

FIG. 1 is an exploded perspective view of an internal combustion engine 10 having a block 12 and a head 14, with a rotary vaned valve of this invention. Engine 10 includes a set of spark plugs 16, typically one per cylinder, and a series of cylinder intake ports 18 (the exhaust portion of the system is not illustrated in this view). These cylinder ports lie along intake head surface 22, which is curved to accept the tubular body of rotary intake valve 26. Rotary intake valve 26 includes a series of circumferentially staggered intake valve ports 30 which periodically align with cylinder intake ports 18 to deliver the fuel/air mixture to the cylinders within the engine block. Rotary valve 26 may include a series of rings or guides 32 engageable with complementary guide channels 34 on head surface 22. Rotary valve 26 also includes a timing gear 36 on one of its ends, which timing gear is connected by a belt, chain, gear or other method to a driving sprocket on the engine crankshaft. These gears are selected to drive the rotary valve in synchronization with the combustion in the cylinders (e.g., a two:one gear ratio for a four-cycle engine). The rotary exhaust valve includes corresponding components.

A design improvement in this invention is that the intake ports 18 (and exhaust ports) in the head should be of a size to define an arc of approximately thirty degrees of the circle described by the outside circumference of the rotary valve tube 26, while the ports 30 in the rotary tube itself should define an arc of approximately sixty degrees of that same circle. The benefit of this arrangement is to enable the valve port to be fully open for approximately thirty degrees of valve rotation, in contrast with prior art rotary valve systems which which are fully open at only one specific instant in their rotation, and less than fully open for the remainder. This tends to duplicate the more desirable valve opening profile of a conventional poppet valve.

Figure 2:
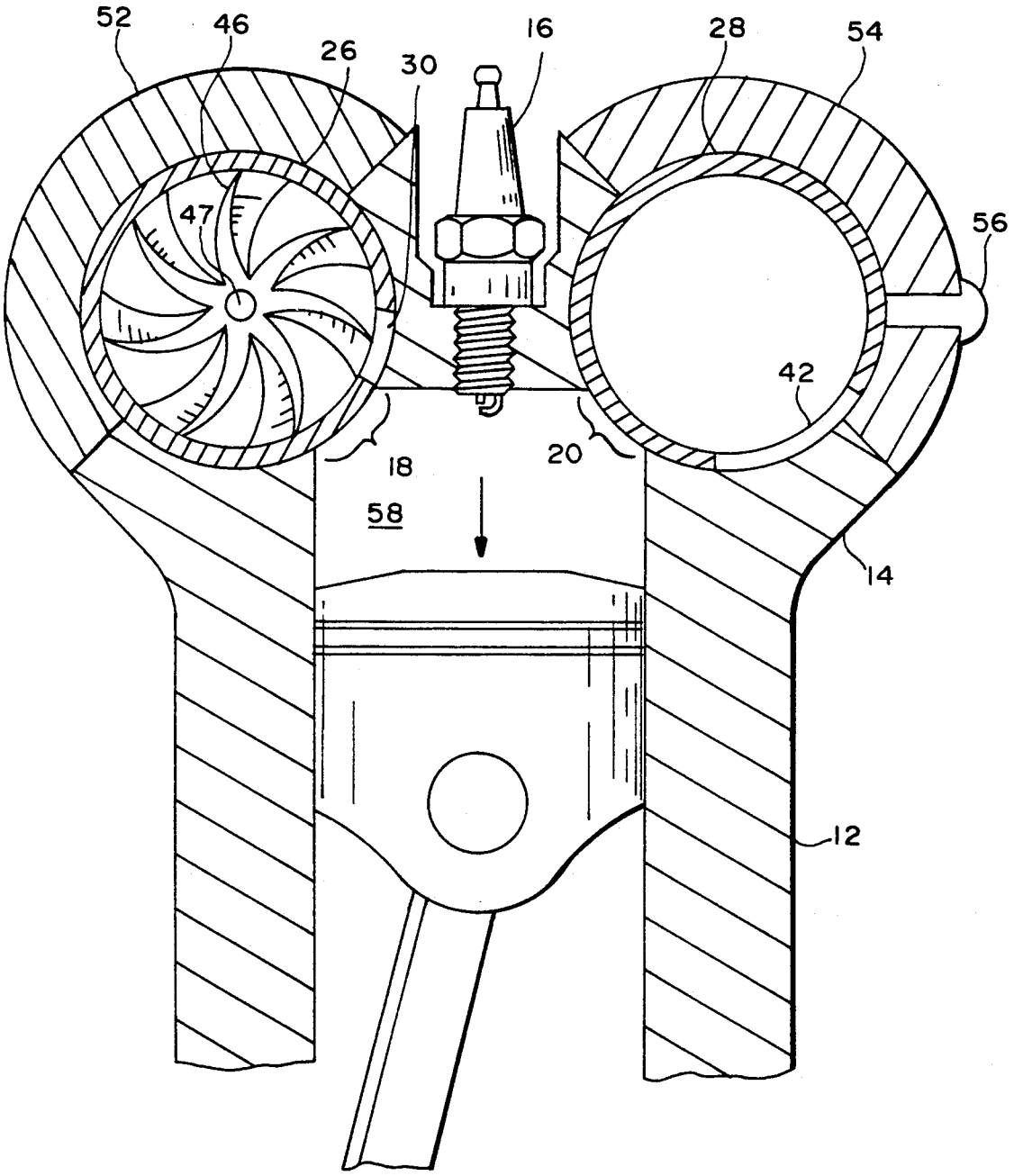
FIG. 2 is a partially cutaway elevated cross-sectional view of an internal combustion engine block and head with a set of the intake and exhaust rotary vaned valves of this invention mounted to the head of the engine block by a pair of valve covers, and further illustrating a water injection system incorporated into the exhaust valve portion.

FIG. 2 is a partially cutaway elevated cross-sectional view of an internal combustion engine block 12 and head 14 with a set of the intake 26 and exhaust 28 rotary vaned valves of this invention mounted to the head of the engine block by a pair of valve covers 52, 54. Rotary intake valve 26 includes at least one set of vanes 46 which are independently mounted on axis 47 to enable them to spin at a greater speed than the rotation of the valve. The effect of these vanes is to supplement the driving of the fuel/air mixture flow through the rotary valve and into the cylinders for combustion. These vanes may be placed anywhere along the rotary valve, but at least one set of vanes is preferably placed upstream of the first cylinder to enhance flow to all of the cylinders.

This view further illustrates a water injection system 56 incorporated into the exhaust valve portion. Injection of water into rotary exhaust valve 28 (e.g., via exhaust valve port 42) causes the water to mix with the hot combustion gases scavenged from cylinder 58 via cylinder exhaust port 20. The injected water thus vaporizes into steam and is exhausted with the combustion gases, and serves to drive the vane set(s) (not visible in this view) of rotary exhaust valve 28. This creates, in effect, an exhaust gas/steam turbine, which recovers energy from the internal combustion process and returns it to the system, thus yielding a more efficient engine.

Figure 3:
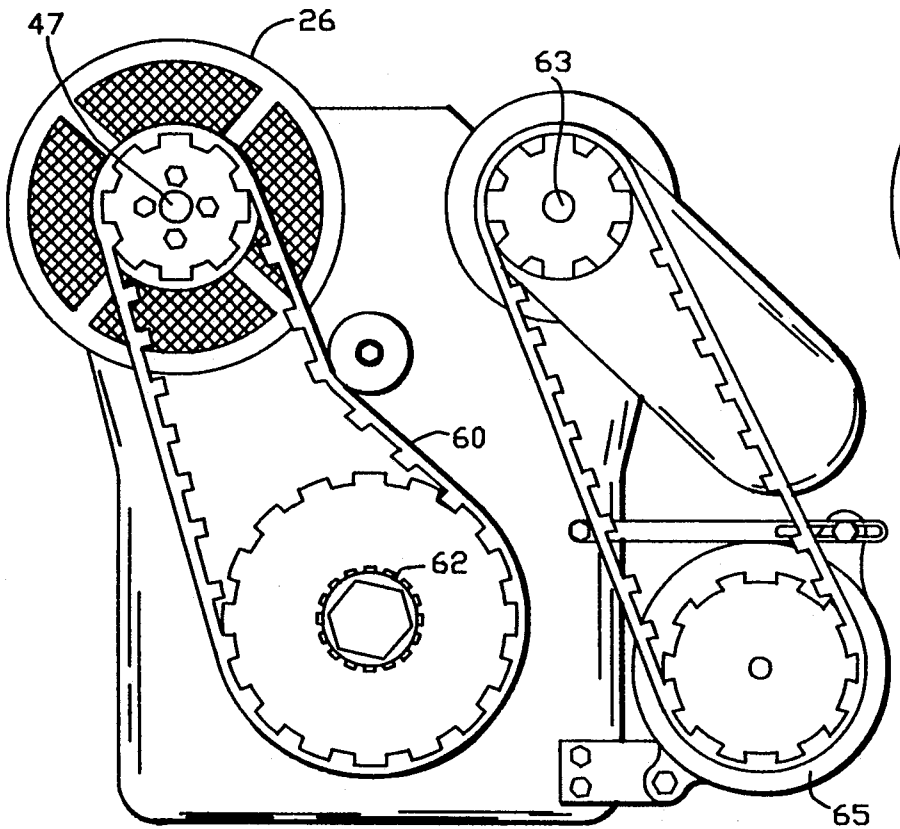
FIG. 3 is an end view of an engine-driven rotary vaned valve of this invention, with exhaust vanes driving an engine accessory.

FIG. 3 is an end view of an engine-driven rotary vaned valve of this invention. Here, the internal intake vane shaft 47 is driven by belt system 60 from engine crankshaft 62. Alternatively, the intake vanes could be electric motor driven and electronically controlled. This drive method would allow precise control of intake gas boost pressure and volume, resulting in optimal engine efficiency. Tubular valve 26 is separately driven in the traditional manner, at a rotational speed of, for example, one-half crankshaft speed. Exhaust vane shaft 63 is used to drive alternator 65. Alternatively, the exhaust vanes could be used to drive any other accessory.

Figure 4:
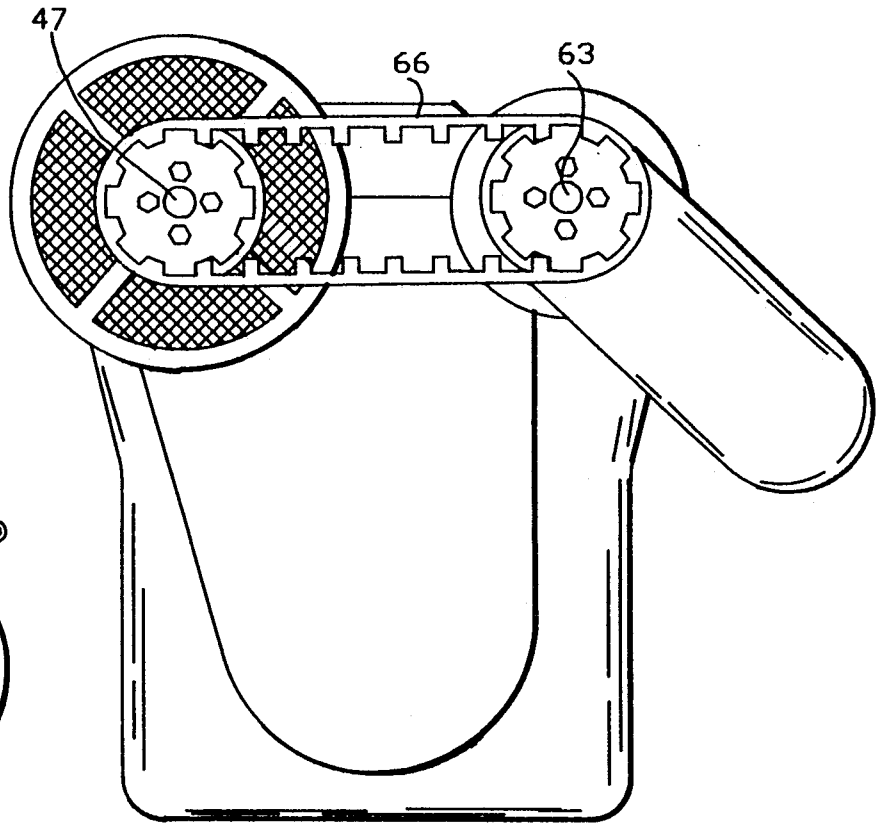
FIG. 4 is an end view of an exhaust-driven rotary vaned valve of this invention.

FIG. 4 is an end view of an exhaust-driven rotary vaned valve of this invention. Here, internal intake vane shaft 47 is driven by exhaust vane shaft 63 via belt system 66.

Figure 5:
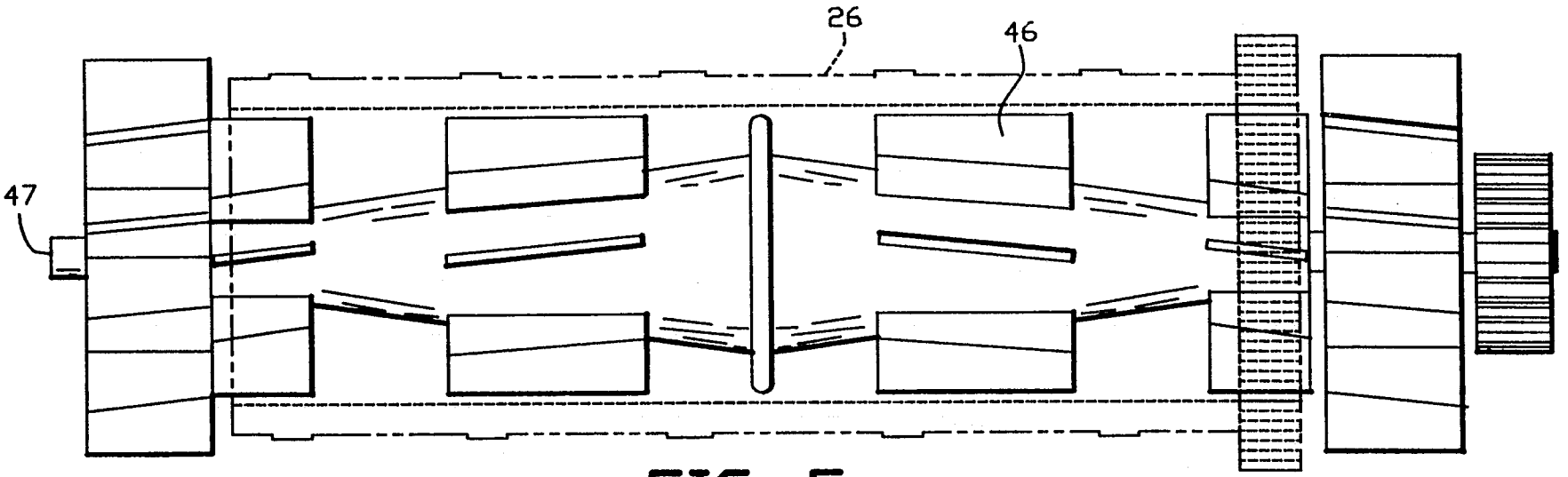
FIG. 5 is a side elevation view of an intake embodiment of the rotary vaned valve of this invention, with the surrounding tubular valve shown in phantom.
Figure 6:
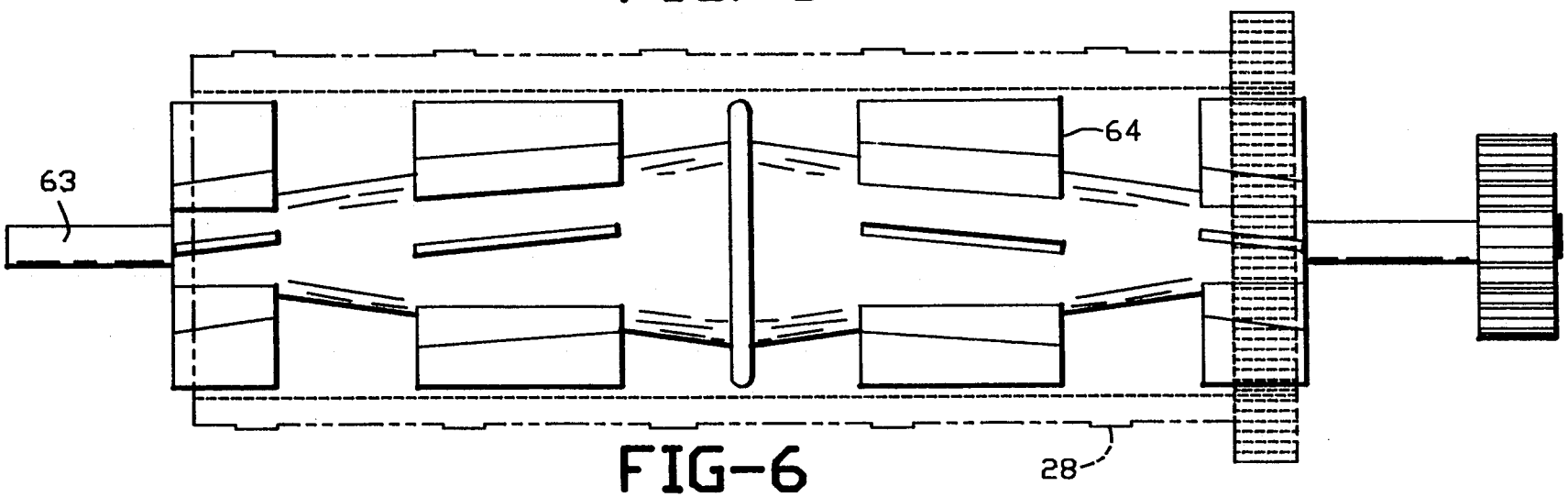
FIG. 6 is a side elevation view of an exhaust embodiment of the rotary vaned valve of this invention, with the surrounding tubular valve shown in phantom.

FIG. 5 is a side elevation view of an intake embodiment of the rotary vanes 46 of this invention, with the surrounding tubular intake valve 26 shown in phantom. FIG. 6 is a side elevation view of an exhaust embodiment of the rotary vanes 64 of this invention, with its surrounding tubular exhaust valve 28 similarly shown in phantom. These views illustrate how the vanes independently rotate within their respective tubular valve.

While this invention has been described in connection with preferred embodiments thereof, it is obvious that modifications and changes therein may be made by those skilled in the art to which it pertains without departing from the spirit and scope of the invention. For example, pressure and/or flow characteristics of the tubular valve can be adjusted by appropriate selection of vane size, vane pitch, vane placement, core diameter, tube diameter, and numerous other factors. Furthermore, this technology is well suited for two-stroke engines, as well as the four-stroke engines described. Accordingly, the scope of this invention is to be limited only by the appended claims.

What is claimed as invention is:

1. A rotary valve for an internal combustion engine having an intake head surface bearing a plurality of cylinder intake ports and an exhaust head surface bearing a plurality of cylinder exhaust ports, said rotary valve having a tubular-shaped body member having a longitudinal axis and a plurality of circumferentially staggered valve ports conditioned to enable gas flow through said valve, said rotary valve including drive means for rotating said body member about said longitudinal axis, the improvement comprising:

a set of vanes independently mounted inside said rotary valve body member; and vane drive means for rotating said vanes within said rotary valve body member, wherein when said rotary valve body member rotates, said vanes independently rotate at a greater rotational speed to enhance gas flow through said rotary valve.

2. The rotary valve of claim 1 wherein said vane drive means comprises a step-up gear driven by said engine.

3. The rotary valve of claim 1 wherein said vane drive means comprises a belt system driven by said engine.

4. The rotary valve of claim 1 including exhaust-driven vanes carried within an exhaust rotary valve body member.

5. The rotary valve of claim 4 including an intake rotary valve bearing intake vanes, wherein said exhaust-driven vanes drive said intake vanes.

6. The rotary valve of claim 4 wherein said exhaust-driven vanes drive an accessory engine component.

7. The rotary valve of claim 6 wherein said accessory engine component comprises an alternator.

8. The rotary valve of claim 4 wherein said internal combustion engine includes means for injection of water into a rotary exhaust valve upstream of said set of exhaust-driven vanes.

9. The rotary valve of claim 1 comprising a rotary intake valve body member having a circumference, wherein said cylinder intake ports are of a size to define an arc of approximately thirty degrees of said rotary intake valve circumference, and said valve ports are of a size to define an arc of approximately sixty degrees of said rotary intake valve circumference.

10. The rotary valve of claim 1 comprising a rotary exhaust valve body member having a circumference, wherein said cylinder exhaust ports are of a size to define an arc of approximately thirty degrees of said rotary exhaust valve circumference, and said valve ports are of a size to define an arc of approximately sixty degrees of said rotary exhaust valve circumference.

* * * * *